US006793840B2

(12) United States Patent
Shin et al.

(10) Patent No.: US 6,793,840 B2
(45) Date of Patent: Sep. 21, 2004

(54) AZEOTROPE MIXTURES WITH PERFLUOROBUTYLETHYLENE

(75) Inventors: Hyunkook Shin, Wilmington, DE (US); Chien-Ping Chai Kao, Newark, DE (US); Thomas A. J. Schweiger, Fayetteville, AR (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/415,563

(22) PCT Filed: Dec. 22, 2000

(86) PCT No.: PCT/US00/35311

§ 371 (c)(1),
(2), (4) Date: Sep. 4, 2003

(87) PCT Pub. No.: WO02/052072

PCT Pub. Date: Jul. 4, 2002

(65) Prior Publication Data

US 2004/0051074 A1 Mar. 18, 2004

(51) Int. Cl.[7] ..... D01D 5/11; D01F 6/04; D01F 6/06; D01F 6/32; C11D 7/50

(52) U.S. Cl. ..... 252/8.81; 106/311; 252/8.84; 264/205; 510/408; 510/415

(58) Field of Search ..... 252/8.81, 8.84; 106/311; 264/205; 510/408, 415

(56) References Cited

U.S. PATENT DOCUMENTS

| | | | | | |
|---|---|---|---|---|---|
| 5,037,572 | A | * | 8/1991 | Merchant | 252/67 |
| 5,039,445 | A | * | 8/1991 | Merchant | 252/67 |
| 5,302,212 | A | * | 4/1994 | Desbiendras et al. | 134/40 |
| 6,153,134 | A | * | 11/2000 | Shin et al. | 264/50 |

FOREIGN PATENT DOCUMENTS

| | | | |
|---|---|---|---|
| EP | 00520860 | A | * 12/1992 |
| WO | WO0036194 | A | * 6/2000 |

* cited by examiner

*Primary Examiner*—Anthony J. Green

(57) ABSTRACT

An azeotropic mixture of perfluorobutylethylene and at least one of the group consisting of bromochloromethane, cyclopentane, cis-1,2 dichloroethylene, trans-1,2 dichloroethylene and dichloromethane useful for cleaning agents, blowing agents and certain of which are suitable for flash spinning of polyolefins to make plexifilamentary fibers.

10 Claims, 13 Drawing Sheets

AZEOTROPE MIXTURES WITH PERFLUOROBUTYLETHYLENE

BACKGROUND OF THE INVENTION

1. Field of the Invention

This invention is directed to azeotropic and azeotropic-like mixtures useful for flash spinning processes and other applications.

2. Description for the Related Art

U.S. Pat. No. 3,081,519 to Blades et al. assigned to E. I. du Pont de Nemours and Company, Wilmington, Del. (hereafter DuPont) discloses a process for making flash-spun plexifilamentary film-fibril strands from a fiber-forming polymer in a liquid spin agent that is not a solvent for the polymer below the liquid's normal boiling point. As disclosed in U.S. Pat. No. 3,227,794 to Anderson et al. (assigned to DuPont), the flash-spinning process requires a spin agent that: (1) is a non-solvent to the polymer below the spin agent's normal boiling point; (2) forms a solution with the polymer at high pressure; (3) forms a desired two-phase dispersion with the polymer when the solution pressure is reduced slightly in a letdown chamber; and (4) flash vaporizes when released from the letdown chamber into a zone of substantially lower pressure through a spin orifice.

Spunbonded products made from polyethylene plexifilamentary film-fibril strands have been produced by flash spinning a spin fluid comprised of polyethylene in a trichlorofluoromethane spin agent. However, trichlorofluoromethane is considered to be a stratospheric ozone depletion chemical, and therefore, there is a need for alternative spin agents for use in the flash-spinning process.

Flashspun products have typically been made from polyethylene. However, it is known that other polymers have higher melting points than does polyethylene and, as such, can provide a flashspun product usable at higher temperatures when compared to product made from polyethylene. Moreover, certain solvents can not dissolve polyethylene but can dissolve other polymers; therefore motivation exists to find solvents that are particularly suited to other polymers and yet satisfy the need for non-flammability and low tendency to deplete the ozone as measured by their global warming potential (GWP). The 100 year GWP can be rated on a scale from 1 for carbon dioxide to greater than 4000 for some perfluorocarbons.

Azeotropic mixtures containing perfluroalkylethylenes have been used for cleaning and drying agents as disclosed in U.S. Pat. No. 5,302,212 to Desbiendras, et al. Azeotropic mixtures have been used as spin agents in flash spinning processes as described in U.S. Pat. No. 6,153,134 issued Nov. 20, 2000 and assigned to DuPont. Spin agents containing perfluorobutylethylene for use in flash spinning are described in related, pending International Patent Application PCT/US00/22729, also assigned to DuPont. Binary azeotropic or azeotrope-like compositions of substantially constant-boiling mixtures can be characterized, depending upon the conditions chosen, in a number of ways. For example, it is well known by those skilled in the art, that, at different pressures the composition of a given azeotrope or azeotrope-like composition will vary at least to some degree, as will the boiling point temperature. Thus, an azeotropic or azeotrope-like composition of two compounds represents a unique type of relationship but with a variable composition that depends on temperature and/or pressure. Therefore, compositional ranges, rather than fixed compositions, are often used to define azeotropes and azeotrope-like compositions.

DETAILED DESCRIPTION OF THE INVENTION

Figure 1:
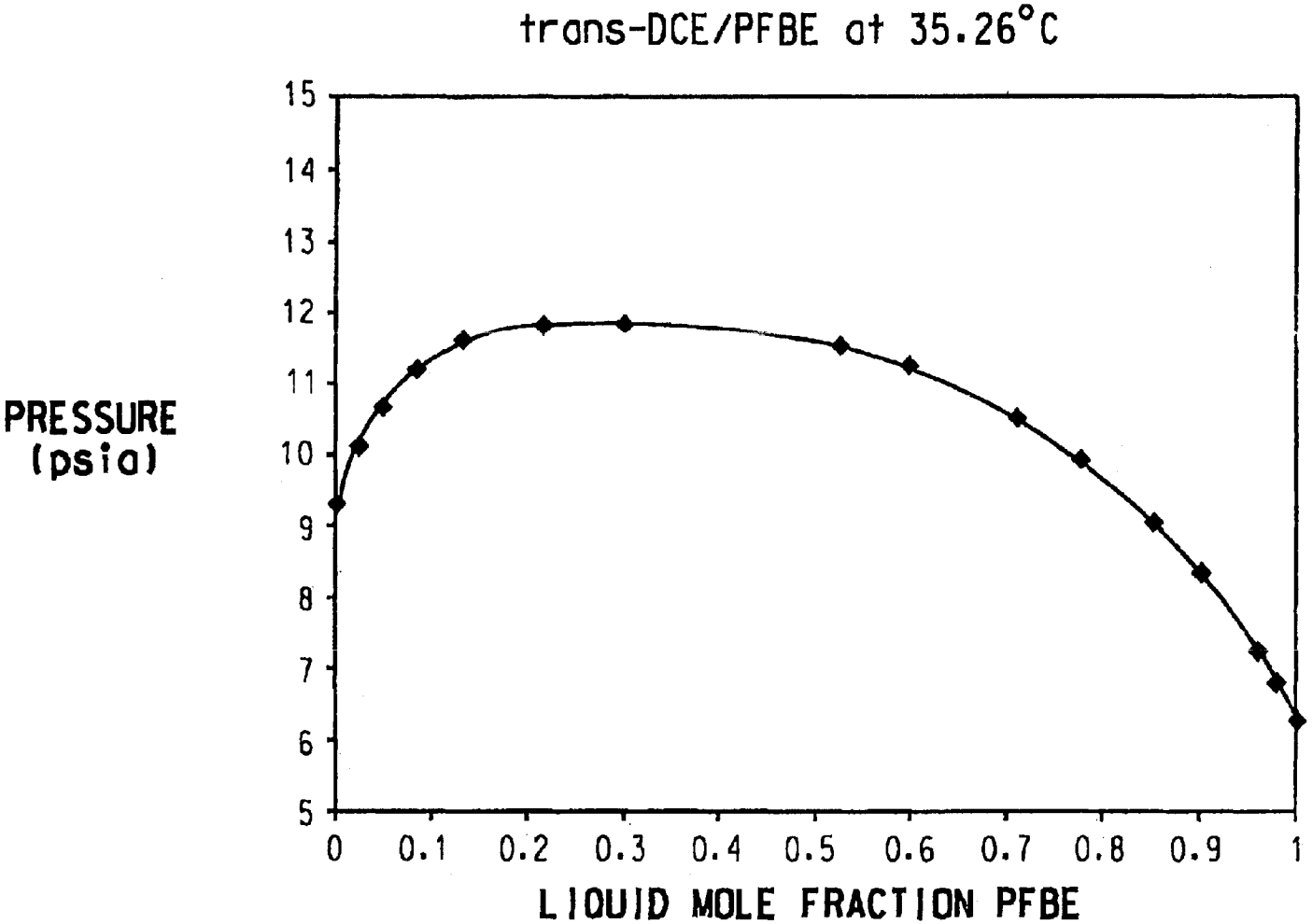
FIG. 1 is a graphical representation of an azeotropic composition of trans-1,2-dichloroethylene (trans-DCE) and perfluorobutylethylene at a temperature of about 35° C.

Following are definitions that will be useful in reading the specification:

The terms "azeotropic composition" or "azeotropic mixture" and "azeotrope composition" as used herein refer to a constant-boiling mixture of two or more compounds that behaves as a pure compound. One way to characterize an azeotropic composition is that the vapor produced by partial evaporation or distillation of the liquid has the same composition as the liquid from which it is evaporated or distilled; i.e., the mixture distills/refluxes without compositional change. Constant-boiling compositions are characterized as azeotropic when they exhibit either a maximum or minimum boiling point, as compared with that of a non-azeotropic mixture of the same components. Azeotropic compositions are also characterized by a minimum or a maximum in the vapor pressure of the mixture relative to the vapor pressure of the neat components at a constant temperature.

The term "azeotrope-like" as used herein refers to a composition that has a constant boiling characteristic or a tendency not to fractionate upon boiling or evaporation. Therefore, the composition of the vapor formed is the same as, or substantially the same as, the original liquid composition. During boiling or evaporation, the liquid composition, if it changes at all, changes only to a negligible extent. An azeotrope-like composition can also be characterized by the area that is adjacent to the maximum or minimum vapor pressure in a plot of composition vapor pressure at a given temperature as a function of mole fraction of components in the composition. A composition is azeotrope-like if, after about 50 weight percent of an original composition is evaporated to produce a remaining composition, the change between the original composition and the remaining composition is no more than about 6 weight percent and typically no more than about 3 weight percent relative to the original composition.

The term "polyolefin" as used herein, is intended to mean any of a series of largely saturated open chain polymeric hydrocarbons composed only of carbon and hydrogen atoms. Typical polyolefins include polyethylene, polypropylene, polymethylpentene and various combinations of the ethylene, propylene, and methylpentene monomers.

The term "polypropylene" as used herein is intended to embrace not only homopolymers of propylene but also copolymers wherein at least 85% of the recurring units are propylene units.

The term "polymethylpentene" as used herein is intended to embrace not only homopolymers of methylpentene but also copolymers wherein at least 85% of the recurring units are methylpentene units.

The term "plexifilamentary" means a three-dimensional integral network of a multitude of thin, ribbon-like, film-fibril elements of random length and with a mean film thickness of less than about 4 micrometers and with a median fibril width of less than about 25 micrometers. In plexifilamentary structures, the film-fibril elements are generally coextensively aligned with the longitudinal axis of the structure and they intermittently unite and separate at irregular intervals in various places throughout the length, width and thickness of the structure to form a continuous three-dimensional network.

The term "spin fluid" as used herein means a solution comprising a fiber-forming polymer, an azeotropic or azeotrope-like spin agent, plus any additives that can be present.

The term "cloud-point pressure" as used herein, means the pressure at which a single-phase liquid solution starts to phase separate into a polymer-rich/spin agent-rich two-phase liquid/liquid dispersion. However, at temperatures above the critical point, there cannot be any liquid phase present and therefore a single phase supercritical solution phase separates into a polymer-rich/spin agent-rich, two-phase gaseous dispersion.

The present invention relates to binary azeotropic and azeotrope-like compositions containing 3,3,4,4,5,5,6,6,6-nonafluoro-1-hexene, also referred to herein as perfluorobutylethylene or PFBE. The azeotropic and azeotrope-like compositions of the invention are useful as spin agents for flash-spinning of fiber-forming polymers, and also as cleaning agents, blowing agents for making foams, or working fluids for electrical parts. The terms azeotrope or azeotropic will be understood to include the term azeotrope-like.

The azeotropic and azeotrope-like compositions of the present invention are binary mixtures that contain perfluorobutylethylene and a second component where the second component is selected from the group consisting of trans-1,2-dichloroethylene, cis-1,2-dichloroethylene, dichloromethane, bromochloromethane, and cyclopentane.

It is recognized in the art that both the boiling point and the amount of each component of an azeotropic composition can change when the azeotrope liquid composition is subjected to boiling at different pressures. Thus, an azeotropic composition may be defined in terms of the unique relationship that exists among components or in terms of the exact amounts of each component of the composition characterized by a fixed boiling point at a specific pressure. An azeotrope or azeotrope-like composition of two compounds can be characterized by defining compositions characterized by a boiling point at a given pressure, thus providing identifying characteristics without unduly limiting the scope of the invention by a specific numerical composition, which is limited by and is only as accurate as the analytical equipment available.

It is recognized in this field that when the relative volatility of a system approaches 1.0, the system is defined as forming an azeotrope-like composition. Relative volatility is the ratio of the volatility of component 1 to the volatility of component 2. The ratio of the mole fraction of a component in vapor to that in liquid is the volatility of the component.

To determine the relative volatility of any two compounds, a method known as the PTx method can be used. In this procedure, the total absolute pressure in a cell of known volume is measured at a constant temperature for various compositions of the two compounds. Use of the PTx Method is described in detail in "Phase Equilibrium in Process Design", Wiley-Interscience Publisher, 1970, written by Harold R. Null, on pages 124 to 126; hereby incorporated by reference.

These measurements can be converted into equilibrium vapor and liquid compositions in the PTx cell by using an activity coefficient equation model, such as the Non-Random, Two-Liquid (NRTL) equation, to represent liquid phase nonidealities. Use of an activity coefficient equation, such as the NRTL equation is described in detail in "The Properties of Gases and Liquids," $4^{th}$ edition, published by McGraw Hill, written by Reid, Prausnitz and Poling, on pages 241 to 387, and in "Phase Equilibria in Chemical Engineering," published by Butterworth Publishers, 1985, written by Stanley M. Walas, pages 165 to 244. Both aforementioned references are hereby incorporated by reference. Without wishing to be bound by any theory or explanation, it is believed that the NRTL equation, together with the PTx cell data, can sufficiently predict the relative volatilities of the perfluorobutylethylene-containing compositions of the present invention and can therefore predict the behavior of these mixtures in multi-stage separation equipment such as distillation columns.

Perfluorobutylethylene (PFBE) has been found to form binary azeotropic compositions with each of the following: trans-1,2-dichloroethylene, cis-1,2-dichloroethylene, dichloromethane, bromochloromethane, and cyclopentane. The azeotropic compositions comprise 30.7 mole % PFBE and 69.3 mole % trans-DCE at 35.3° C. and 11.9 pounds per square inch absolute (psia)(82 kPa); 43.0 mole % PFBE and 57.0 mole % cis-DCE at 60.0° C. and 20.2 psia (139 kPa); 22.1 mole % PFBE and 77.9 mole % dichloromethane at 40.0° C. and 17.4 psia (120 kPa); 51.3 mole % PFBE and 48.7 mole % bromochloromethane at 60.0° C. and 20.6 psia (142 kPa); and 32.3 mole % PFBE and 67.7 mole % cyclopentane at 40.0° C. and 13.6 psia (94 kPa). From these data it has been calculated that PFBE forms binary azeotropic and azeotrope-like mixtures having a range of compositions for the pressure ranges shown in Table 1. These ranges may occur elsewhere in the specification in rounded-off form.

TABLE 1

Compositions of PFBE binary azeotropes

| 2nd Component | Mole Fract PFBE | Mole Fract 2nd Component | Boiling Point (° C.) | Pressure psia (kPa) |
|---|---|---|---|---|
| trans-1,2-DCE | 0.3066–0.3046 | 0.6934–0.6954 | 35–130 | 11.9–139.7 (82–963) |
| cis-1,2-DCE | 0.4304–0.4562 | 0.5696–0.5438 | 60–140 | 20.2–140.7 (139–970) |
| Dichloro-methane | 0.2212–0.2001 | 0.7788–0.7999 | 40–140 | 17.4–207.9 (120–1433) |
| Bromochloro-methane | 0.5125–0.5045 | 0.4875–0.4955 | 60–140 | 20.6–144.6 (142–997) |
| Cyclopentane | 0.3231–0.3471 | 0.6769–0.6529 | 40–140 | 13.6–168.2 (94–1160) |

The azeotropic or azeotrope-like compositions of the invention are useful as spin agents for flash spinning of fiber-forming polymers. It has been a goal in flash spinning processes to find spin agents that have low flammability and low GWP. With the exception of bromochloromethane, the spin agents of the subject invention have GWP of less than 20. They also have very low flammability, with the exception of cyclopentane. However, in the case of the cyclopentane/PFBE azeotrope, 63 wt % is PFBE and only 37 wt % is cyclopentane. Therefore, the flammability of cyclopentane is much reduced by the presence of PFBE.

Fiber-forming synthetic polymers that can be flash-spun using the azeotropic or azeotrope-like compositions of the invention as spin agents include polyolefins such as polypropylene and poly(4-methyl pentene-1), and blends thereof. Other fiber-forming synthetic polymers that can be flash spun using certain of the azeotropic compositions described above as the spin agent include partially fluorinated hydrocarbon polymers in which between 10% and 70% of the total number of hydrogen atoms in the hydrocarbon polymer are replaced by fluorine atoms. Preferably, the partially fluorinated hydrocarbon polymers are comprised of at least 80% by weight of polymerized monomer units selected from ethylene, tetrafluoroethylene, chlorotrifluoroethylene, vinylidene fluoride and vinyl fluoride. A particularly preferred partially fluorinated hydrocarbon polymer is comprised of 40% to 70% by weight of polymerized monomer units of tetrafluoroethylene and 30% to 60% by weight of polymerized monomer units of ethylene, such as a copolymer comprised of substantially alternating units of ethylene and tetrafluoroethylene with the chemical structure $—(CH_2CH_2)—(CF_2CF_2)—$. Such ethylene/tetrafluoroethylene copolymers are disclosed, for example, in U.S. Pat. No. 3,624,250 to Carlson (assigned to DuPont), U.S. Pat. No. 3,870,689 to Modena et al., and U.S. Pat. No. 4,677,175 to Ihara et al. Ethylene/tetrafluoroethylene copolymer resin is commercially available from DuPont under the tradename TEFZEL®, which is a registered trademark of DuPont. TEFZEL® fluoropolymer resins have melting points between 235° and 280° C. Another partially fluorinated hydrocarbon polymer that may be flash-spun using certain of the azeotropic compositions described above as the spin agent is a copolymer of alternating monomer units of ethylene and chlorotrifluoroethylene, such as HALAR® fluoropolymer resin obtained from Ausimont.

Test Methods

Prior to denier measurement and tensile testing, each plexifilamentary strand was tensioned by hanging a 40-gram load to it for three minutes to remove bends and waviness.

Tenacity and elongation of the flash-spun strand were determined with an Instron tensile-testing machine. The strands were conditioned and tested at 70° F. (21° C.) and 65% relative humidity. The strands were twisted to 10 turns per inch (2.54 cm) and mounted in the jaws of the Instron Tester. A two-inch (5.08 cm) gauge length was used with an initial elongation rate of 4 inches (20.3 cm) per minute. The tenacity at break is recorded in grams per denier (gpd). The elongation at break is recorded as a percentage of the two-inch gauge length of the sample. Modulus corresponds to the slope of the stress/strain curve and is expressed in units of gpd.

The apparatus and procedure for determining the cloud point pressures of the polymer/spin agent combinations are those described in U.S. Pat. No. 5,147,586 to Shin et al.

Test Apparatus for Examples 6–12

The apparatus used in Example 6–12 is the spinning apparatus described in U.S. Pat. No. 5,147,586 to Shin et al. The apparatus consists of two high-pressure cylindrical chambers, each equipped with a piston which is adapted to apply pressure to the contents of the chamber. The cylinders have an inside diameter of 1.0 inch (2.54 cm) and each has an internal capacity of 50 cubic centimeters. The cylinders are connected to each other at one end through a 3/32 inch (0.23 cm) diameter channel and a mixing chamber containing a series of fine mesh screens that act as a static mixer. Mixing is accomplished by forcing the contents of the vessel back and forth between the two cylinders through the static mixer. A spinneret assembly with a quick-acting means for opening the orifice is attached to the channel through a tee. The spinneret assembly consisted of a lead hole of 0.25 inch (0.63 cm) diameter and about 2.0 inch (5.08 cm) length with a 60 degree entrance angle to the orifice, and a spinneret orifice with a length and a diameter each measuring 30 mils (0.762 mm). The pistons are driven by high-pressure water supplied by a hydraulic system.

In the tests reported in Examples 6–12, the apparatus described above was charged with polymer pellets and an azeotropic spin agent. High-pressure water was used to drive the pistons to generate a mixing pressure (back pressure) of approximately 2500 to 3000 psig (17133–20581 kPa). The polymer and spin agent were then heated to the mixing temperature and held at that temperature for 30 minutes, during which time the pistons were used to alternately establish a differential pressure between the two cylinders so as to repeatedly force the polymer and spin agent through the mixing channel from one cylinder to the other to provide mixing and to effect formation of a spin fluid. The spin fluid temperature was then adjusted to the final spin temperature, and held there for about 15 minutes or longer to equilibrate the temperature, during which time mixing was continued. In order to simulate a pressure letdown chamber, the pressure of the spin fluid was reduced to a desired spinning pressure just prior to spinning. This was accomplished by opening a valve between the spin cell and a much larger tank of high-pressure water ("the accumulator") held at the desired spinning pressure. The spinneret orifice is opened as rapidly as possible after the opening of the valve between the spin cell and the accumulator. This generally takes about one second. This is intended to simulate the letdown chamber effect that is used in larger scale spinning operations. The resultant flash-spun product was collected in a stainless steel open mesh screen basket. The pressure recorded just before the spinneret using a computer during spinning is entered as the spin pressure.

It is noted that pressures may be expressed as psig (pounds per square inch gage) which is approximately 15 psi less than psia (pound per square inch absolute). The unit psi is considered the same as psia. For converting to SI units, 1 psi=6.9 kPa.

EXAMPLES

Examples 1–5

Examples 1–5 demonstrate the existence of azeotropic or azeotrope-like compositions between the binary pairs consisting essentially of PFBE and trans-1,2-dichloroethylene (trans-DCE); PFBE and cis-1,2-dichloroethylene (cis-DCE); PFBE and dichloromethane; PFBE and bromochloromethane; and PFBE and cyclopentane. To determine the relative volatility of each binary pair, the PTx Method was used. In this procedure, for each binary pair, the total absolute pressure in a sample cell having a volume of 85 ml or 950 ml was measured at constant temperature for various binary compositions. These measurements were then reduced to equilibrium vapor and liquid compositions using the NRTL equation. The vapor pressure measured versus the composition in the PTx sample cell for these binary systems are shown in FIGS. 1 through 5. The experimental data points are shown in each Figure as solid points and the solid line is drawn from data calculated using the NRTL equation.

FIG. 1 illustrates graphically the formation of an azeotropic composition of trans-DCE and PFBE at 35.3° C., as indicated by a mixture of about 69.3 mole % trans-DCE and 30.7 mole % PFBE having the highest pressure over the range of compositions at this temperature. Based upon these findings, it has been calculated that an azeotropic or azeotrope-like composition of 69.5 mole % trans-DCE and 30.5 mole % PFBE is formed at 130° C. and 139.7 psia (963 kPa). Accordingly, the present invention provides an azeotropic or azeotrope-like composition of from about 30.5 to about 30.7 mole % trans-DCE and from about 69.5 to about 69.3 mole % PFBE, said composition having a boiling point of from about 130° C. at about 139.7 psia (963 kPa) to about 35° C. at about 11.9 psia (82 kPa).

Figure 2:
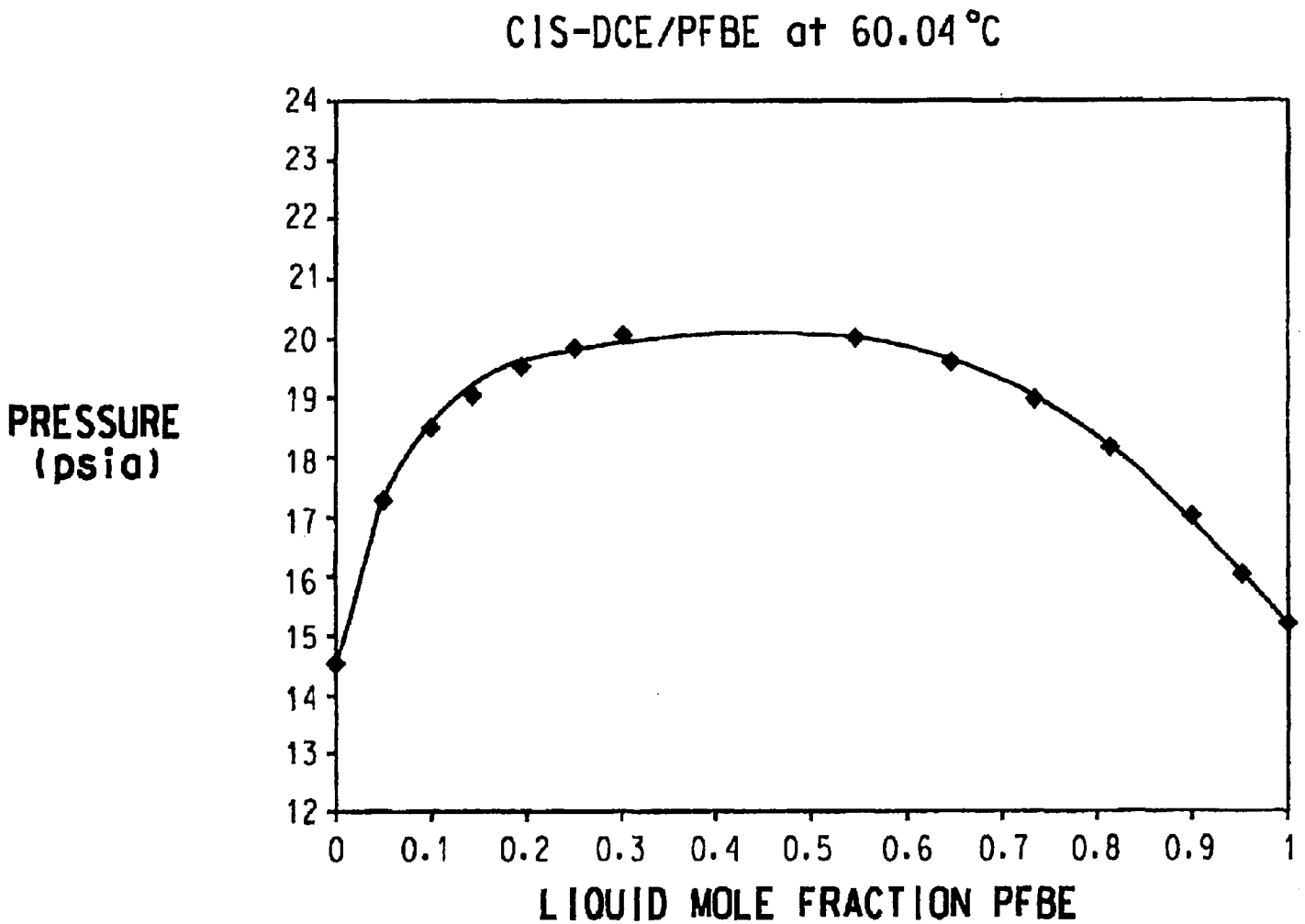
FIG. 2 is a graphical representation of an azeotropic composition of cis-1,2-dichloroethylene (cis-DCE) and perfluorobutylethylene at a temperature of about 60° C.

FIG. 2 illustrates graphically the formation of an azeotropic composition of cis-DCE and PFBE at 60° C., as indicated by a mixture of 57 mole % cis-DCE and 43 mole % PFBE having the highest pressure over the range of compositions at this temperature. Based upon these findings, it has been calculated that an azeotropic or azeotrope-like composition of 54.4 mole % cis-DCE and 45.6 mole % PFBE is formed at 140° C. and 140.7 psia (970 kPa). Accordingly, the present invention provides an azeotropic or azeotrope-like composition of from about 54.4 to about 57.0 mole % cis-DCE and from about 45.6 to about 43.0 mole % PFBE, said composition having a boiling point of from about 140° C. at about 140.7 psia (970 kPa) to about 60° C. at about 20.2 psia (139 kPa).

Under conditions generally used in flash-spinning processes on a large scale, some portion of the trans-1,2-dichloroethylene can isomerize to form cis-1,2-dichloroethylene. The amount of cis-1,2-dichloroethylene present in the spin fluid under a steady state condition can vary from less than 5% to greater than 50%, depending on the amount of stabilizers added to the spin fluid, operating temperature, and the rate of make-up spin agent added to the system. Therefore, whenever trans-1,2-dichloroethylene is used herein as part of the azeotropic spin agent, it is understood to include both trans- and cis-1,2-dichloroethylene, and the corresponding azeotropic composition will lie somewhere between the azeotropic compositions of trans-1,2-dichloroethylene/PFBE and cis-1,2-dichloroethylene/PFBE.

Figure 3:
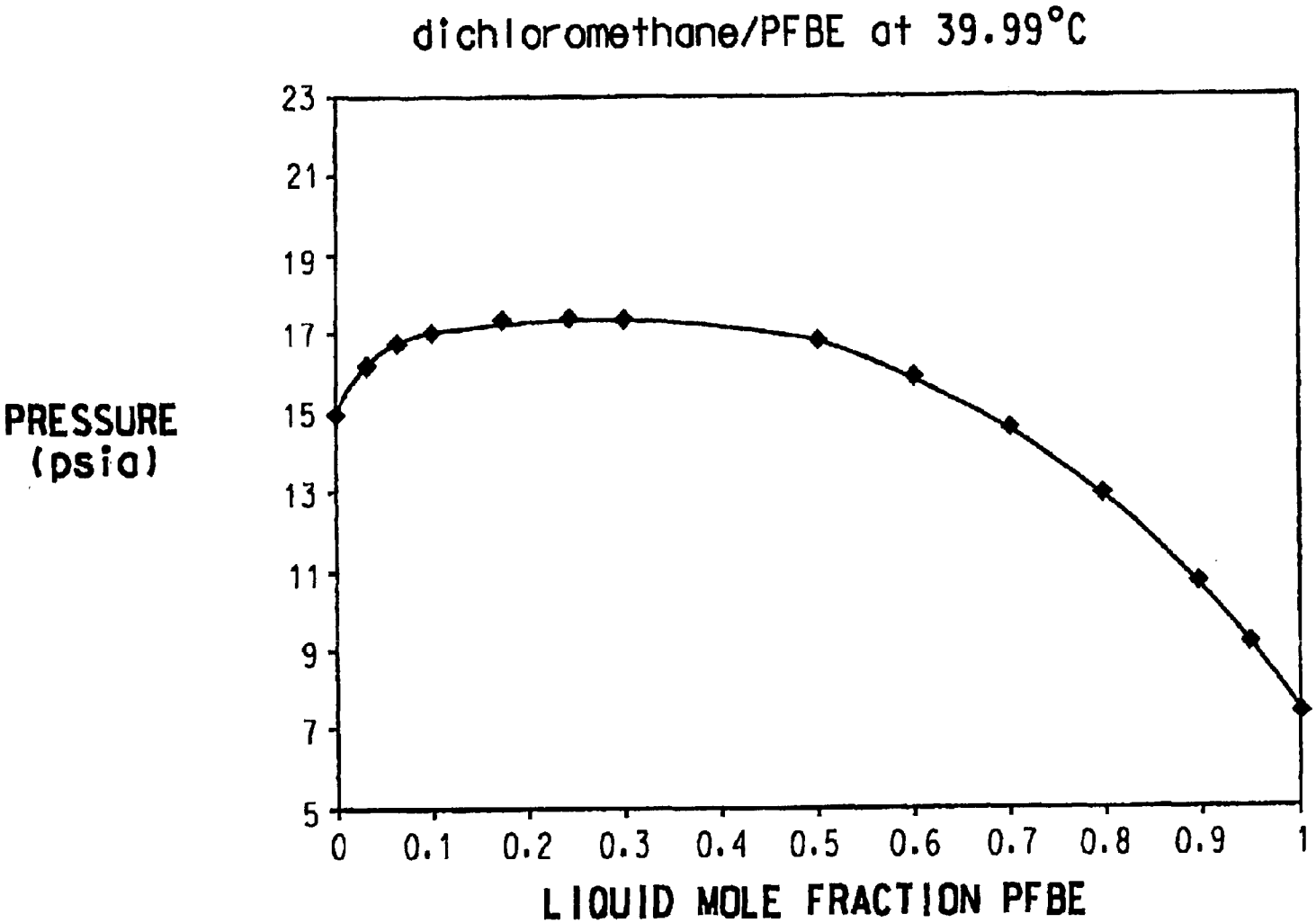
FIG. 3 is a graphical representation of an azeotropic composition of dichloromethane ($CH_2Cl_2$) and perfluorobutylethylene at a temperature of about 40° C.

FIG. 3 illustrates graphically the formation of an azeotropic composition of dichloromethane and PFBE at 40° C., as indicated by a mixture of 77.9 mole % dichloromethane and 22.1 mole % PFBE having the highest pressure over the range of compositions at this temperature. Based upon these findings, it has been calculated that an azeotropic or azeotrope-like composition of 80.0 mole % dichloromethane and 20.0 mole % PFBE is formed at 140° C. and 207.9 psia (1433 kPa). Accordingly, the present invention provides an azeotropic or azeotrope-like composition of from about 80.0 to about 77.9 mole % dichloromethane and from about 20.0 to about 22.1 mole % PFBE, said composition having a boiling point of from about 140° C. at about 207.9 psia (1433 kPa) to about 40° C. at about 17.4 psia (120 kPa).

Figure 4:
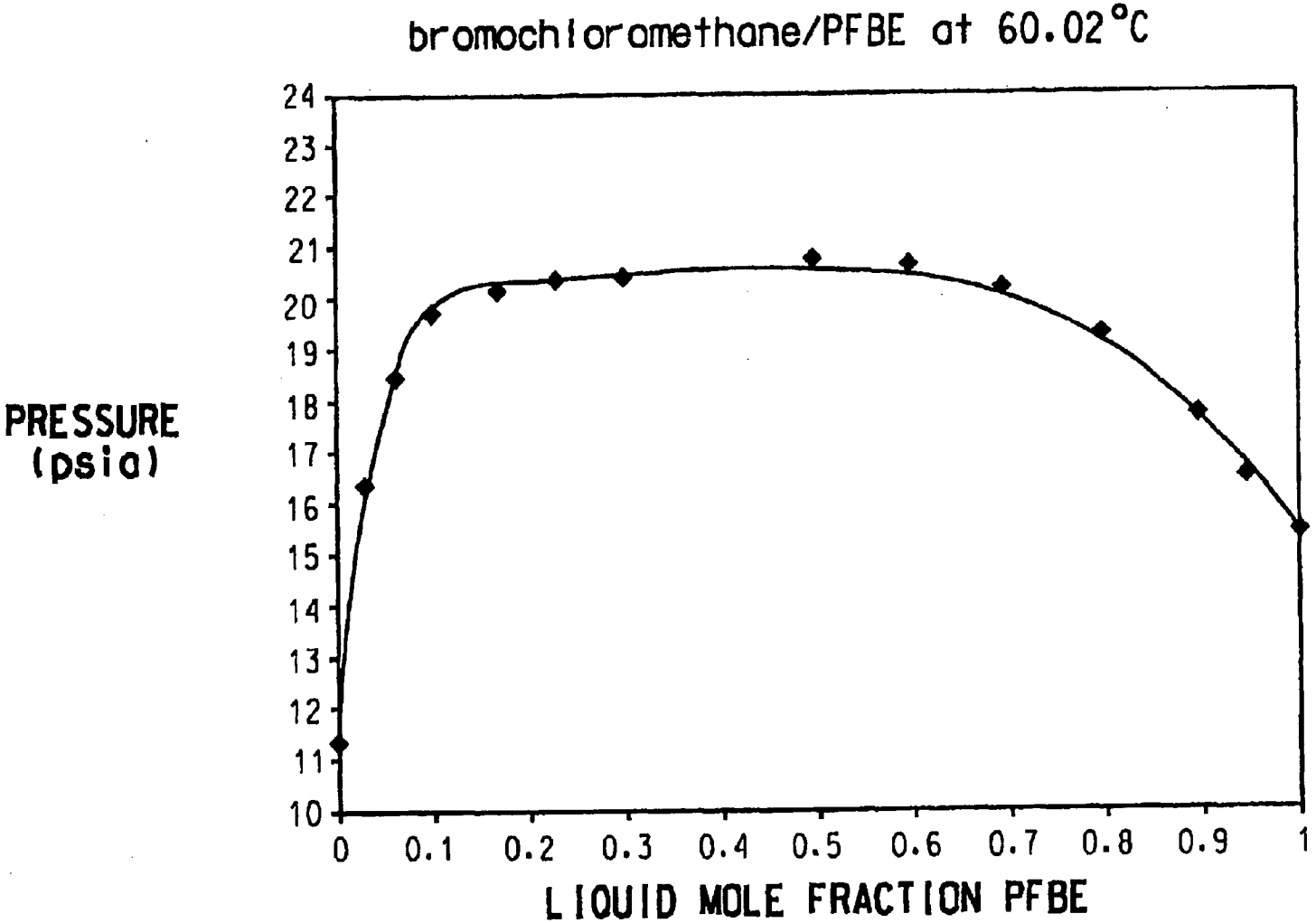
FIG. 4 is a graphical representation of an azeotropic composition of bromochloromethane ($CH_2BrCl$) and perfluorobutylethylene at a temperature of about 60° C.

FIG. 4 illustrates graphically the formation of an azeotropic composition of bromochloromethane and PFBE at 60° C., as indicated by a mixture of 48.7 mole % bromochloromethane and 51.3 mole % PFBE having the highest pressure over the range of compositions at this temperature. Based upon these findings, it has been calculated that an azeotropic or azeotrope-like composition of 49.6 mole % bromochloromethane and 50.4 mole % PFBE is formed at 140° C. and 144.6 psia (997 kPa). Accordingly, the present invention provides an azeotropic or azeotrope-like composition of from about 48.7 to about 49.6 mole % bromochloromethane and from about 51.3 to about 50.4 mole % PFBE, said composition having a boiling point of from about 60° C. at about 20.6 psia (142 kPa) to about 140° C. at about 144.6 psia (997 kPa).

Figure 5:
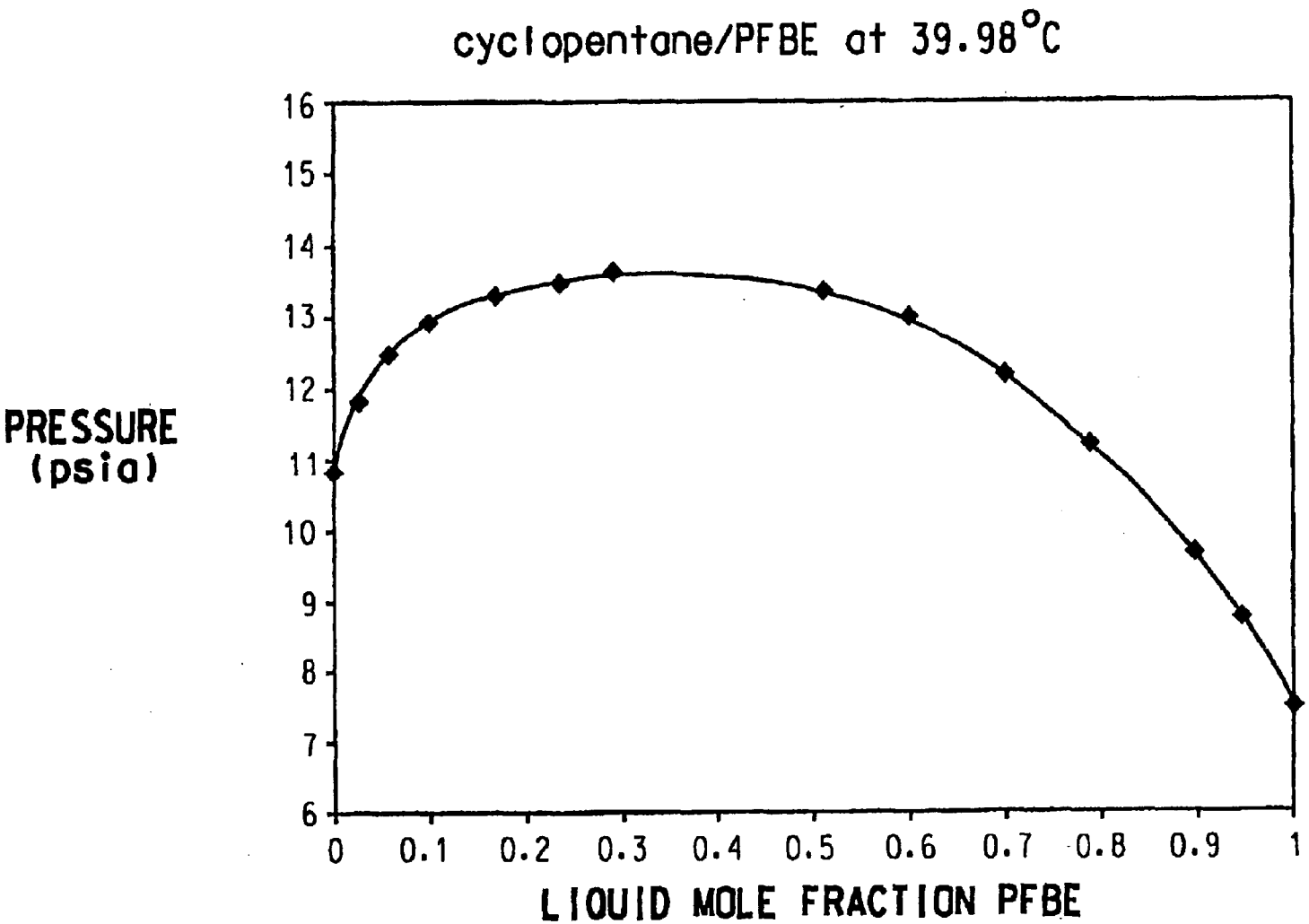
FIG. 5 is a graphical representation of an azeotropic composition of cyclopentane and perfluorobutylethylene at a temperature of about 40° C.
Figure 6:
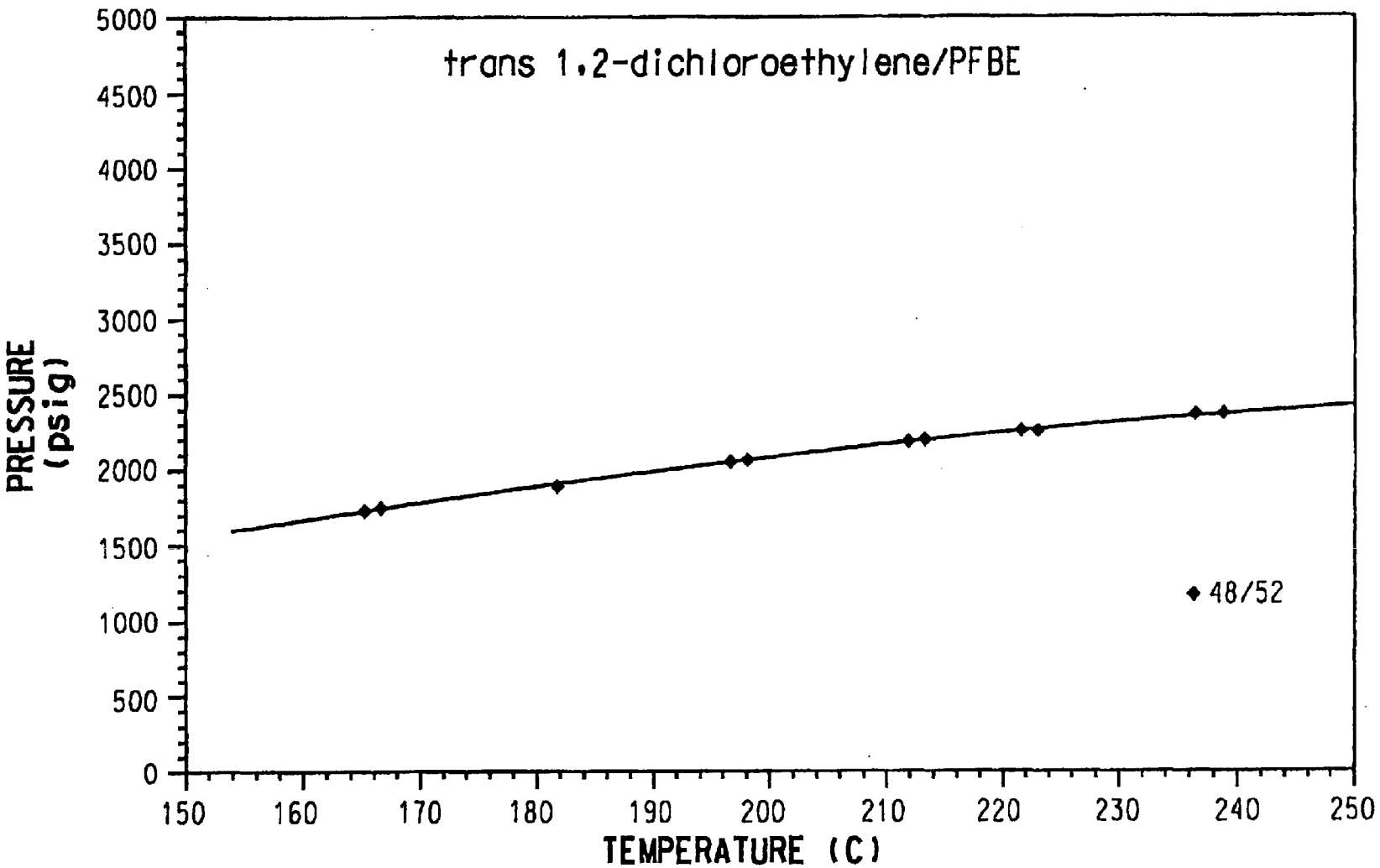
FIG. 6 is a plot of cloud point data for 10% by weight polypropylene in a spin agent of an azeotropic mixture of trans-1,2-dichloroethylene and perfluorobutylethylene expressed in weight percent.
Figure 7:
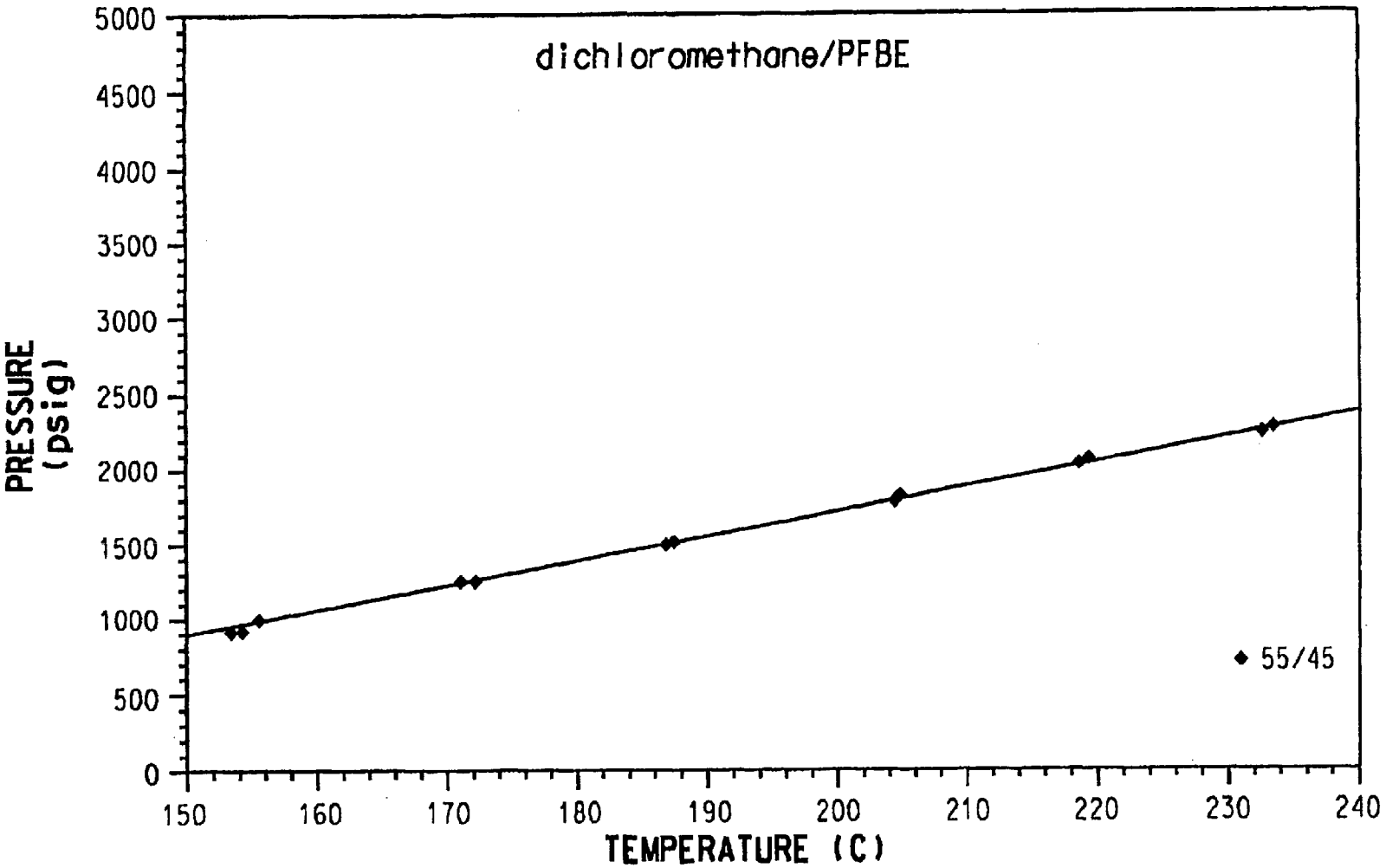
FIG. 7 is a plot of cloud point data for 10% by weight polypropylene in a spin agent of an azeotropic mixture of dichloromethane and perfluorobutylethylene expressed in weight percent.
Figure 8:
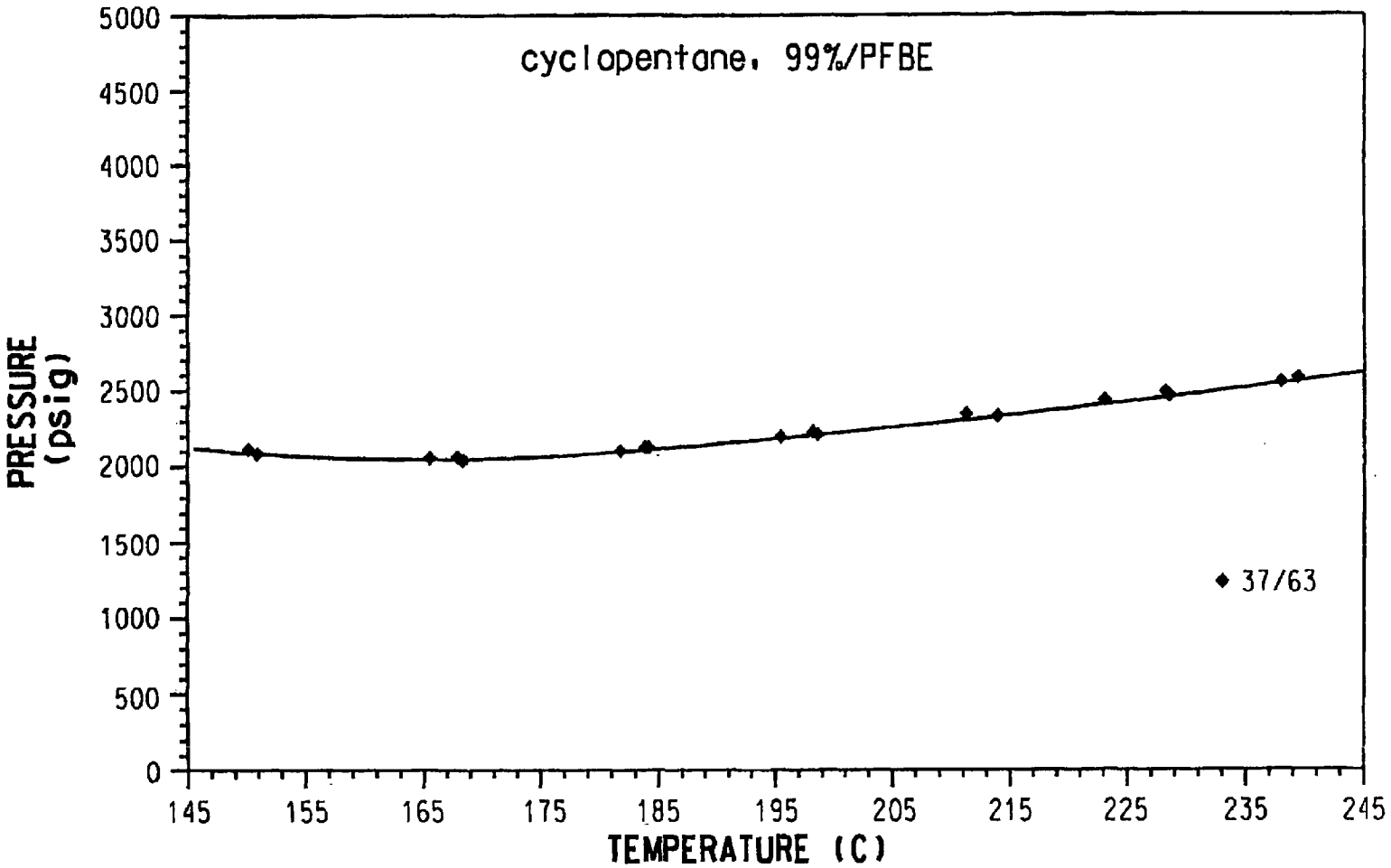
FIG. 8 is a plot of cloud point data for 10% by weight polypropylene in a spin agent of an azeotropic mixture of cyclopentane and perfluorobutylethylene expressed in weight percent.
Figure 9:
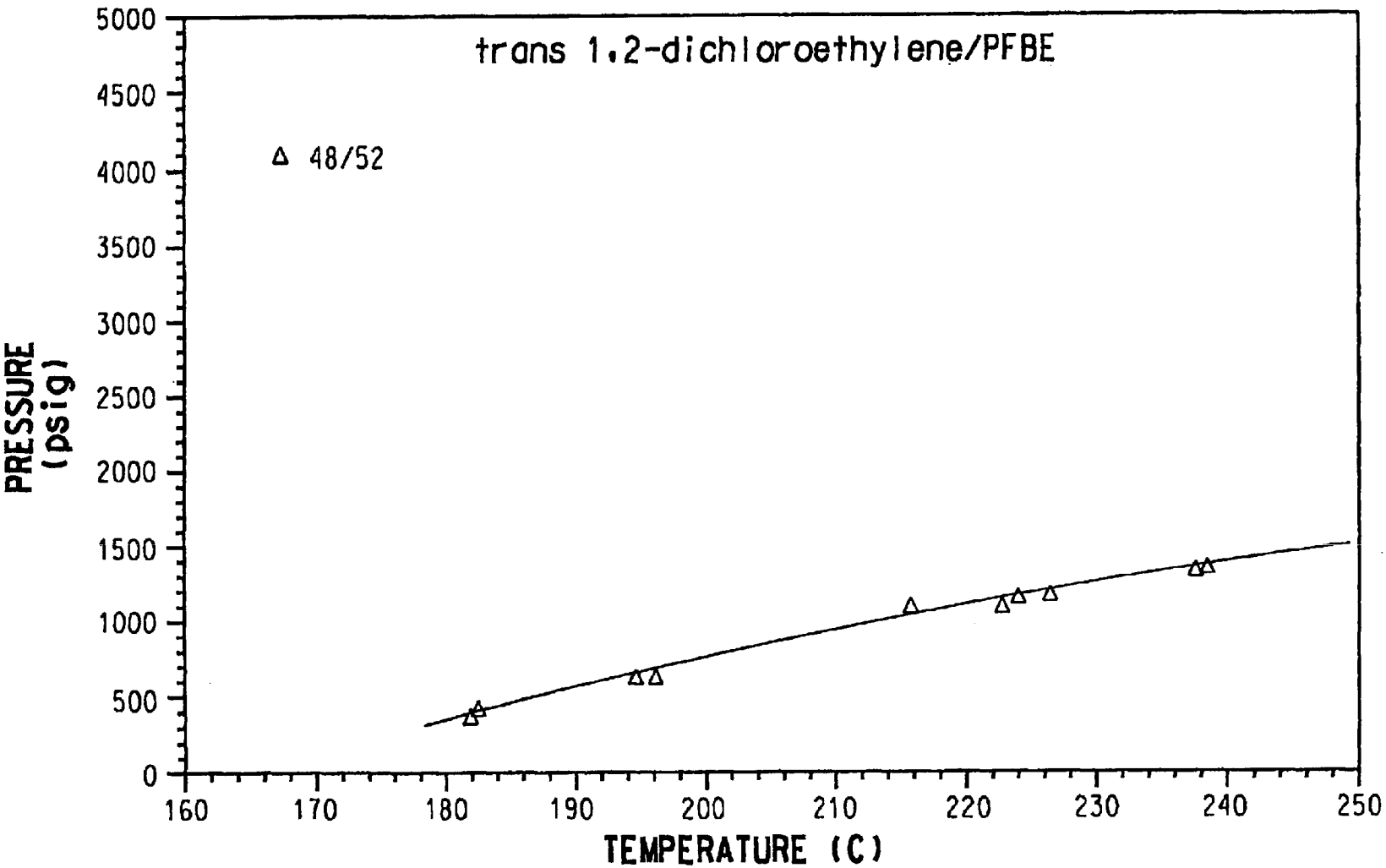
FIG. 9 is a plot of cloud point data for 20% by weight Tefzel® fluoropolymer in a spin agent of an azeotropic mixture of trans-1,2-dichloroethylene and perfluorobutylethylene expressed in weight percent.
Figure 10:
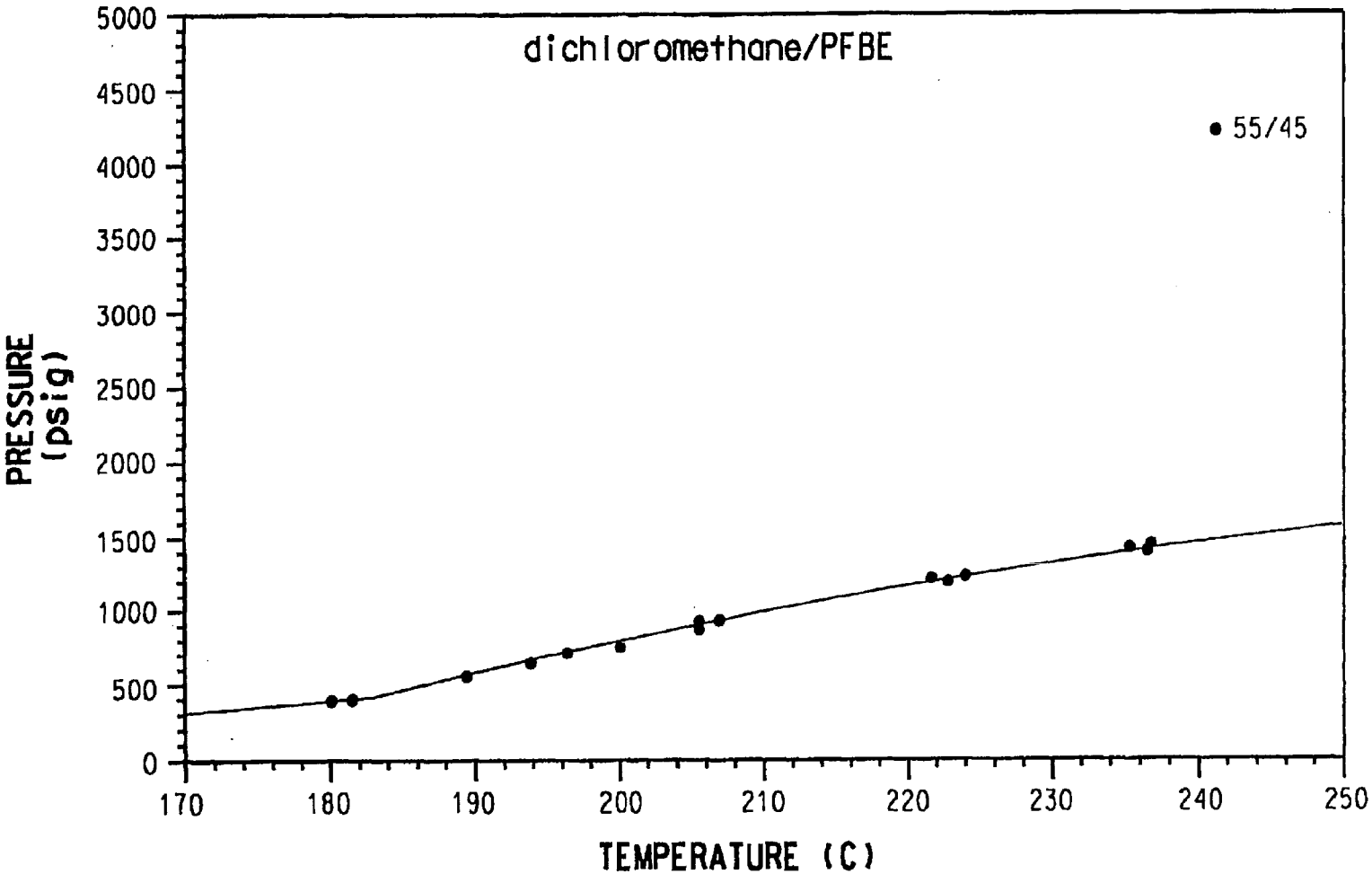
FIG. 10 is a plot of the cloud point data for 20% by weight Tefzel® fluoropolymer in a spin agent of an azeotropic mixture of dichloromethane and perfluorobutylethylene expressed in weight percent.
Figure 11:
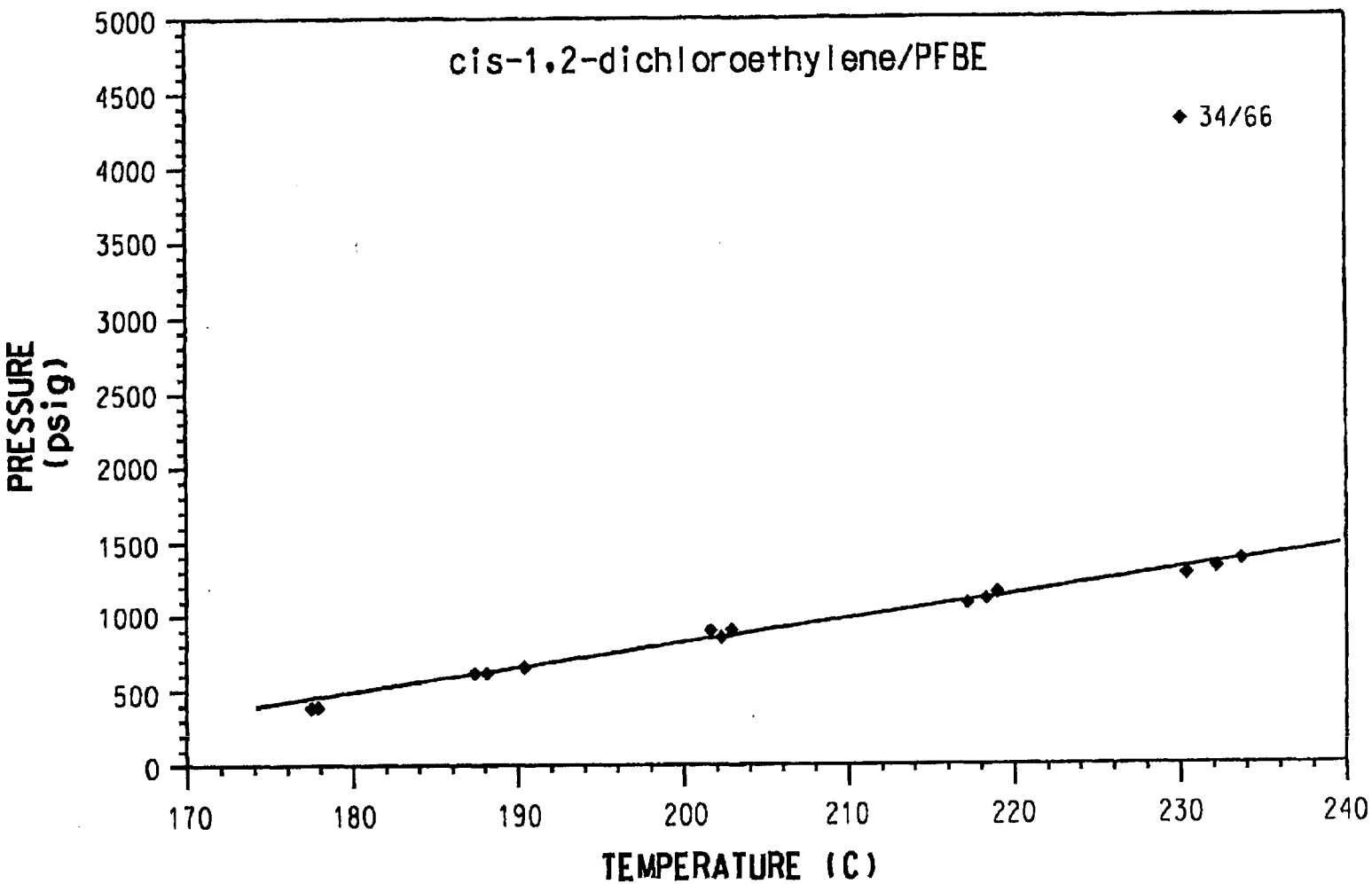
FIG. 11 is a plot of the cloud point data for 20% by weight Tefzel® fluoropolymer in a spin agent of an azeotropic mixture of cis-1,2-dichloroethylene and perfluorobutylethylene.
Figure 12:
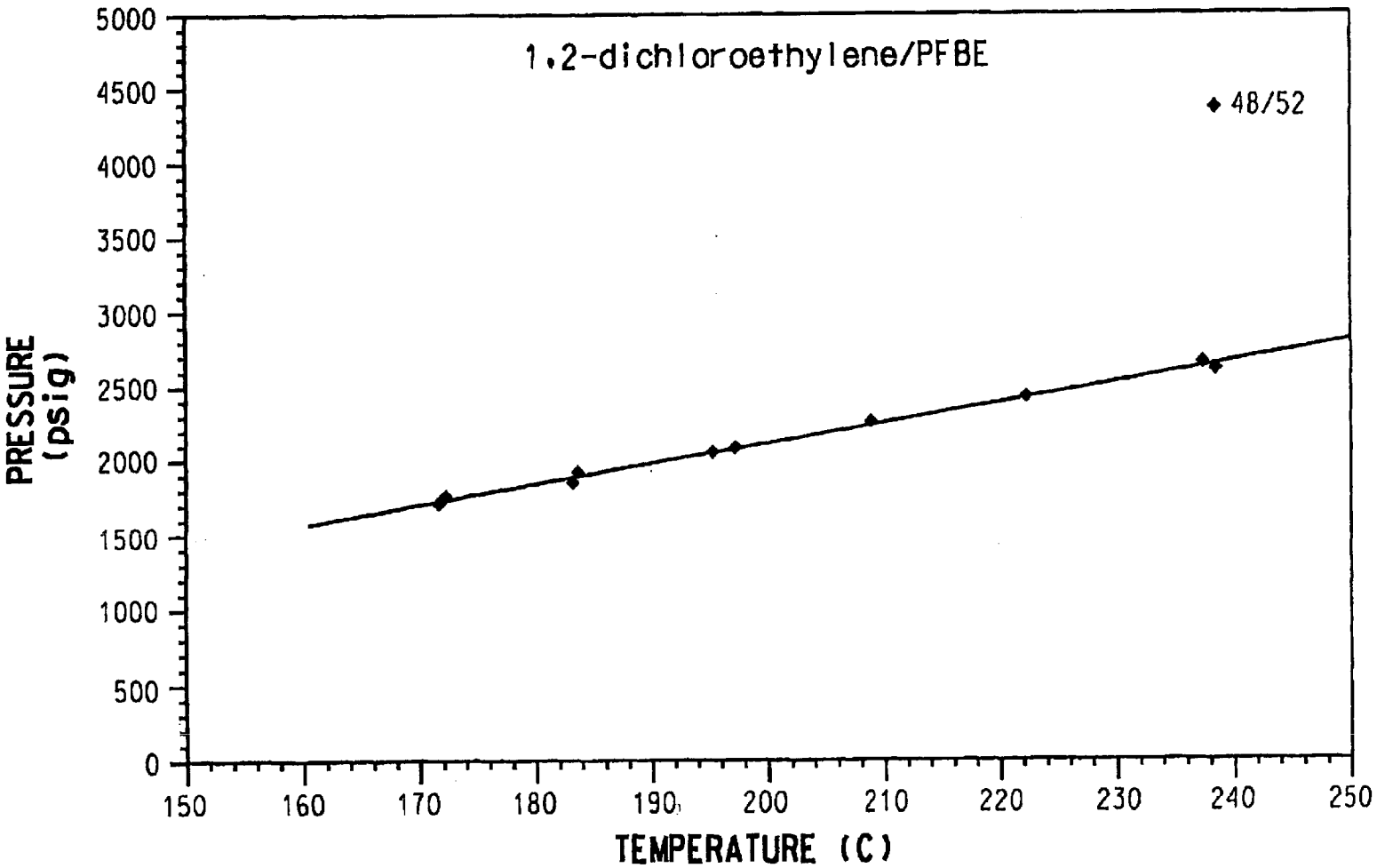
FIG. 12 is a plot of the cloud point data for 20% by weight Halar® fluoropolymer in a spin agent of an azeotropic mixture of trans-1,2-dichloroethylene and perfluorobutylethylene expressed in weight percent.
Figure 13:
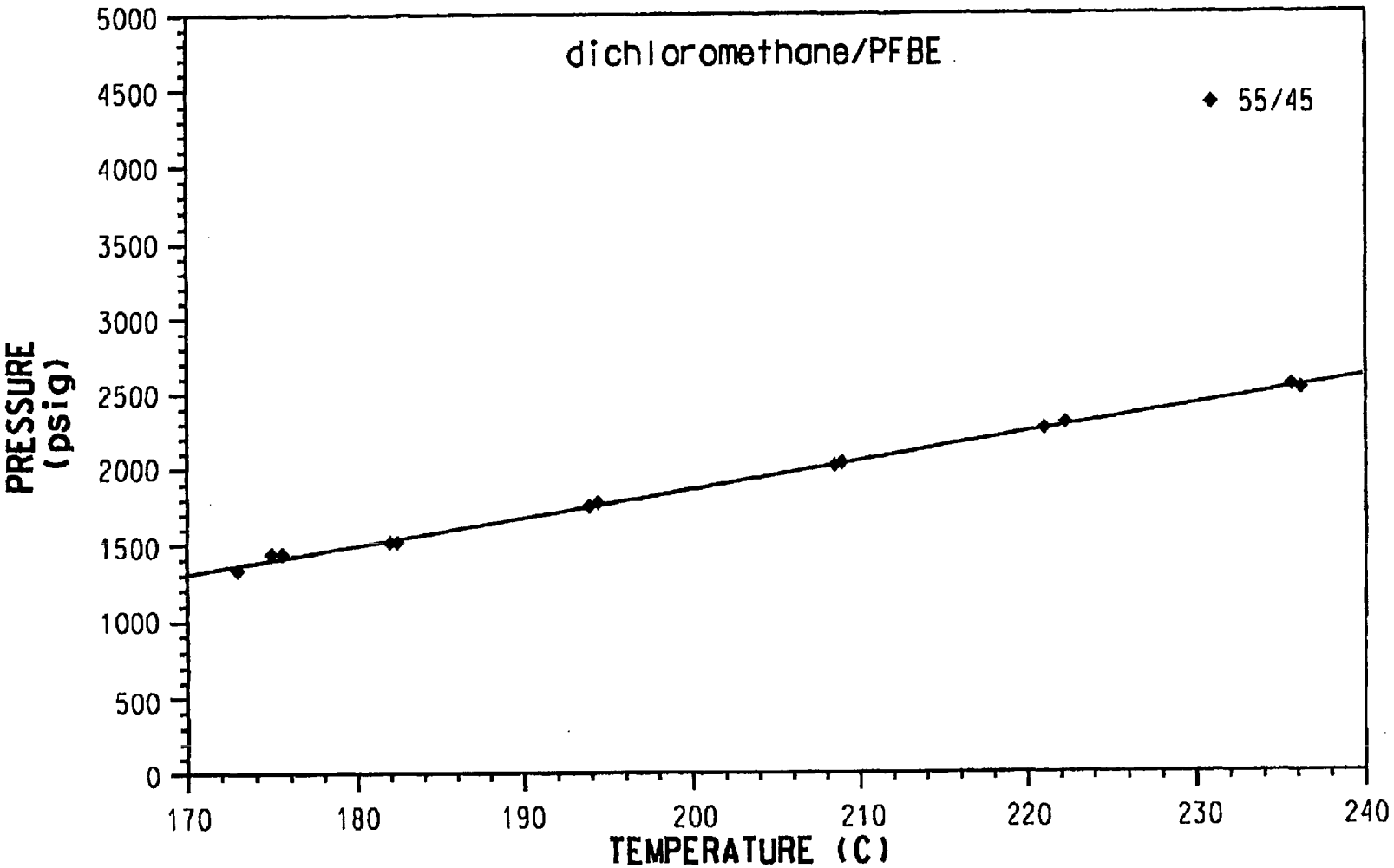
FIG. 13 is a plot of the cloud point data for 20% by weight Halar® fluoropolymer in a spin agent of an azeotropic mixture of dichloromethane and perfluorobutylethylene expressed in weight percent.

FIG. 5 illustrates graphically the formation of an azeotropic and azeotrope-like composition consisting essentially of cyclopentane and PFBE at 40° C., as indicated by a mixture of 67.7 mole % cyclopentane and 32.3 mole % PFBE having the highest pressure over the range of compositions at this temperature. Based upon these findings, it has been calculated that an azeotropic or azeotrope-like composition of 65.3 mole % cyclopentane and 34.7 mole % PFBE is formed at 140° C. and 168.2 psia (1160 kPa). Accordingly, the present invention provides an azeotropic or azeotrope-like composition consisting essentially of from about 65.3 to about 67.7 mole % cyclopentane and from about 34.7 to about 32.3 mole % PFBE, said composition having a boiling point of from about 140° C. at about 168.2 psia (1160 kPa) to about 40° C. at about 13.6 psia (94 kPa).

Examples 6–12

Spin fluids were prepared using azeotropic spin agents, as described above, and having the polymer concentrations as identified in Table 2. Zonyl® perfluorobutylethylene, obtained from DuPont, was a common ingredient used to prepare the azeotropic spin agents. The other ingredients for making the azeotropic spin agents were obtained as follows: trans-1, 2 DCE was from PPG Industries, Inc., Pittsburgh, Pa. (cis-1,2 DCE was also obtained from PPG although it is not commercially available); bromochloromethane was obtained from Albemarle Corp., Baton Rouge, La.

Polypropylene (experimental grade 89-6, obtained from Montell) having a melt flow rate of 1.4 g/10 min (measured according to ASTM D1238 at 190° C. and 2.16 kg load) and a melting point of 165° C. was used in Examples 6–8. In Example 7 (dichloromethane/PFBE azeotropic spin agent), a diphosphite thermal stabilizer (Weston 619F, from GE Specialty Chemicals) was added at 0.1 weight percent, based on total spin agent.

Tefzel® fluoropolymer (grade HT 2127, obtained from DuPont) was used in Examples 9 and 10. Tefzel® HT 2127 fluoropolymer is a copolymer of substantially alternating monomer units of ethylene and tetrafluoroethylene with a melt flow rate of 7 g/10 min (measured according to ASTM D3159) and a melting point of about 240° C.

Halar® fluoropolymer resin (grade 901, obtained from Ausimont), comprising a copolymer of ethylene and chlorotrifluoroethylene, was used in Examples 11 and 12. Halar® 901 fluoropolymer resin has a melting point of 240° C. and a melt index of about 1 g/10 min.

The spin agents were the azeotrope compositions identified in Examples 1–5. The spin fluids were flash-spun using the method described above and spin conditions given in Table 2 to obtain well-fibrillated plexifilaments having the properties shown in Table 2. The weight percent polymer in Table 2 is reported as the weight percent based on the total weight of the spin fluid, whereas the compositions of the spin agent are reported as weight percent based on the total weight of the spin agent.

TABLE 2

Flash Spinning using binary PFBE-containing Azeotropes

| Ex | Polymer | Spin Agent | Mixing Temp (° C.) | Mixing Back P psig (kPa) | Mixing ΔP psig (kPa) |
|---|---|---|---|---|---|
| 6 | Polypropylene (9 wt %) | trans-DCE (48 wt %) PFBE (52 wt %) | 215 | 3000 (20581) | 700 (4723) |
| 7 | Polypropylene (10 wt %) | $CH_2Cl_2$ (55 wt %) PFBE (45 wt %) | 220 | 2500 (20581) | 600 (4033) |
| 8 | Polypropylene (10 wt %) | Cyclopentane (37 wt %) PFBE (63 wt %) | 210 | 3000 (20581) | 700 (4723) |
| 9 | Tefzel ® 2127 (20 wt %) | trans-DCE (48 wt %) PFBE (52 wt %) | 220 | 2500 (17133) | 700 (4723) |
| 10 | Tefzel ® 2127 (20 wt %) | $CH_2Cl_2$ (55 wt %) PFBE (45 wt %) | 220 | 2500 (17133) | 600 (4033) |
| 11 | Halar ® 901 (20 wt %) | trans-DCE (48 wt %) PFBE (52 wt %) | 230 | 3000 (20581) | 700 (4723) |
| 12 | Halar ® 901 (20 wt %) | $CH_2Cl_2$ (55 wt %) PFBE (45 wt %) | 230 | 3000 (20581) | 600 (4033) |

| Ex-ample | Spinning Accum P Psig (kPa) | Spinning Spin P Psig (kPa) | Spinning Temp (° C.) | Properties Denier | Properties Modu-lus (gpd) | Properties Tenac-ity (gpd) | Properties Elong. (%) |
|---|---|---|---|---|---|---|---|
| 6 | 2150 (14720) | 1900 (12997) | 215 | 254 | 3.8 | 1.25 | 116 |
| 7 | 1800 (12307) | 1650 (11273) | 220 | 240 | 7.4 | 2.62 | 104 |
| 8 | 2050 (14031) | 1900 (12997) | 201 | 318 | 4.8 | 1.82 | 111 |
| 9 | 1100 (7481) | 1075 (7308) | 221 | 316 | 10.3 | 1.88 | 25 |
| 10 | 1150 (7826) | 1000 (6791) | 220 | 302 | 9.8 | 1.7 | 18 |
| 11 | 2400 (16444) | 2250 (15410) | 230 | 605 | 12.2 | 1.57 | 22 |
| 12 | 2250 (15410) | 2075 (14203 | 230 | 517 | 12.9 | 1.35 | 19 |

The results of Table 2 show that plexifilamentary strands having desirable properties are formed.

What is claimed is:

1. An azeotropic composition of from 51 to 50 mole percent of perfluorobutylethylene and from 49 to 50 mole percent of bromochloromethane, the composition having a boiling point of from 60° C. at 20.6 psia (142 kPa) to 140° C. at 144.6 psia (997 kPa).

2. An azeotropic composition of from 32 to 35 mole percent of perfluorobutylethylene and from 68 to 65 mole percent of cyclopentane, the composition having a boiling point of from 40° C. at 13.6 psia to 140° C. at 168.2 psia.

3. An azeotropic composition of from 31 to 30 mole percent of perfluorobutylethylene and from 69 to 70 mole percent of trans-1,2-dichloroethylene, the composition having a boiling point of from 35° C. at 11.9 psia (82 kPa) to 130° C. at 139.7 psia (963 kPa).

4. An azeotropic composition of from 43 to 46 mole percent of perfluorobutylethylene and from 57 to 54 mole percent of cis-1,2-dichloroethylene, the composition having a boiling point of from 60° C. at 20.2 psia (139 kPa) to 140° C. at 140.7 psia (970 kPa).

5. A spin fluid consisting essentially of (a) 5 to 30 wt. % of a synthetic fiber-forming polymer and (b) a spin agent selected from the azeotropic composition of one of claims 1–4.

6. A spin fluid of (a) 5 to 30 wt. % of a synthetic fiber-forming polymer selected from the group consisting of polyolefins, and partially fluorinated hydrocarbons, and (b) a spin agent selected from the group consisting of (i) an azeotropic mixture of 31 to 30 mole percent of perfluorobutylethylene and from 69 to 70 mole percent of trans-1,2-dichloroethylene, the mixture having a boiling point of from 35° C. at 11.9 psia (82 kPa) to 130° C. at 139.7 psia (963 kPa) and (ii) an azeotropic mixture of 22 to 20 mole percent of perfluorobutylethylene and from 78 to 80 mole percent of dichloromethane, the mixture having a boiling point of from 40° C. at 17.4 psia (120 kPa) to 140° C. at 207.9 psia (1433 kPa).

7. The spin fluid of claim 6, wherein the synthetic fiber-forming polymer is a polyolefin selected from the group consisting of polypropylene and polymethylpentene.

8. The spin fluid of claim 6, wherein the partially fluorinated hydrocarbon is selected from the group of consisting of a copolymer of ethylene and tetrafluoroethylene and a copolymer of ethylene and chlorotrifluoroethylene.

9. A process for the preparation of plexifilamentary film-fibril strands which comprises the steps of:

(A) generating a spin fluid consisting essentially of (1) 5 to 30 wt. % of a synthetic fiber-forming polymer selected from the group consisting of polyolefins, and partially fluorinated hydrocarbons and (2) a spin agent which is an azeotropic composition of perfluorobutylethylene and one selected from of the group consisting of bromochloromethane, cyclopentane, cis-1,2 dichloroethylene, trans-1,2 dichloroethylene and dichloromethane (B) flash-spinning the spin fluid at a pressure that is greater than autogenous pressure at the spin fluid Into a region of lower pressure to form plexifilamentary film-fibril strands of the synthetic fiber-forming polymer.

10. The process of claim 9, wherein the polyolefin is selected from the group consisting of polypropylene and polymethylpentene and wherein the partially fluorinated hydrocarbon is selected from the group of consisting of a copolymer of ethylene and tetrafluoroethylene and a copolymer of ethylene and chlorotrifluoroethylene.

* * * * *

UNITED STATES PATENT AND TRADEMARK OFFICE

CERTIFICATE OF CORRECTION

PATENT NO. : 6,793,840 B2 
DATED : September 21, 2004
INVENTOR(S) : Shin Hyunkook, Kao Chien-Ping Chai and Schweiger Thomas A.J.

It is certified that error appears in the above-identified patent and that said Letters Patent is hereby corrected as shown below:

Column 10,
Line 45, delete “at” and insert -- of --.
Line 45, delete “Into” and insert -- into --.

Signed and Sealed this

Twelfth Day of April, 2005

JON W. DUDAS
*Director of the United States Patent and Trademark Office*